US005483906A

United States Patent [19]

Hufton

[11] Patent Number: 5,483,906

[45] Date of Patent: Jan. 16, 1996

[54] RELATING TO SOLID FUEL BURNERS

[75] Inventor: Peter F. Hufton, Derby, Great Britain

[73] Assignee: Rolls-Royce Power Engineering plc, Newcastle upon Tyne, England

[21] Appl. No.: 326,834

[22] Filed: Oct. 21, 1994

[30] Foreign Application Priority Data

Oct. 26, 1993 [GB] United Kingdom ..... 9322016

[51] Int. Cl.[6] ..... F23D 1/02

[52] U.S. Cl. ..... 110/260; 110/261; 431/354

[58] Field of Search ..... 110/260, 261, 110/262, 263, 264, 265; 431/354

[56] References Cited

U.S. PATENT DOCUMENTS

| | | | |
|---|---|---|---|
| 3,859,935 | 1/1975 | Walker | 110/260 |
| 4,434,727 | 3/1984 | McCartney | 110/261 |
| 4,803,932 | 2/1989 | Siwersson et al. | 110/261 |
| 4,899,670 | 2/1990 | Hansel | 110/260 |
| 5,199,355 | 4/1993 | Larue | 110/261 |
| 5,263,426 | 11/1993 | Morita et al. | 110/264 |
| 5,392,720 | 2/1995 | Briggs et al. | 110/264 |
| 5,415,539 | 5/1995 | Musil | 431/354 |

*Primary Examiner*—John T. Kwon
*Attorney, Agent, or Firm*—Cushman Darby & Cushman

[57] ABSTRACT

A solid particulate fuel/air burner has opposing fluted members within a rectangular conduit which in operation forms a nozzle. Splitter plates with the fluted members define passages through which a particulate solid fuel and air flow to a combustion chamber. The passages so defined provide and control separate streams of the mix such that flame retention at the exit of the conduit is achieved and reduced NOx is produced and the gathering of ash in the conduit avoided by the obviation of recirculation of the products of combustion into the conduit.

6 Claims, 1 Drawing Sheet

RELATING TO SOLID FUEL BURNERS

The present invention relates to burners of the kind used in industrial boilers. Such burners receive flows of particulate coal and air and burn it in a combustion chamber via which the resulting heat is conducted to water so as to produce steam for driving a turbine.

Environmental needs dictate that burners of the kind described hereinbefore, are designed so that the production of pollutants, especially NOx, is at least minimised during operation of the burner.

It has been ascertained that if the burner flame can be persuaded to remain attached to the outlet plane of the burner nozzle, this feature when used in conjunction with the correct fuel/airflow characteristics, enables a considerable reduction in the amount of NOx produced, relative to previous burners. One way of achieving this result is disclosed and claimed in European Patent Application EPO343767A, which is in common ownership with the present invention.

Devices of the kind referred to hereinbefore, can be prevented from working efficiently by build up of products of combustion in the form of ash, within the flow passages of the burner. Flow disturbance results which can prevent flame retention at the nozzle outlet plane, and in any event, could force a shut down of the associated plant for cleaning purposes.

The present invention seeks to provide an improved solid fuel burner.

According to the present invention, a solid fuel burner comprises a hollow structure having an inlet connectable to particulate solid fuel and air delivery means and includes an outlet passage the inner wall surfacing of which diverges from said inlet to the outlet thereof and on which surfacing tapered fluted means are provided the troughs of the flutes of which are deepest at the said outlet end of the outlet passage, said troughs defining with a splitter plate which spans the structure to define divergent passage portions which in operation cause a reduction in velocity of a particulate solid fuel/airflow therethrough to ensure flame retention on the planer downstream ends of the flutes and non breakaway of the particulate solid fuel/airflow from the surfaces of the troughs thereof, so as to avoid ash recirculation.

The invention will now be described by way of example and with reference to the accompanying drawings in which.

Figure 1:
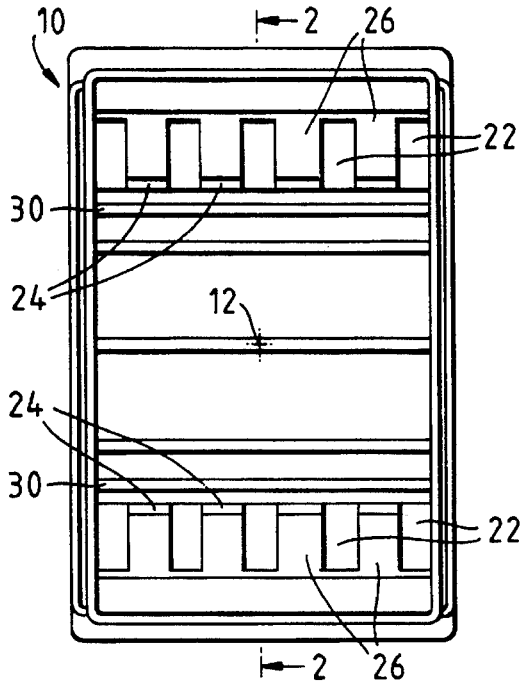
FIG. 1 is a view on a burner in accordance with the present invention, in the direction of arrow 1 in FIG. 2.
Figure 2:
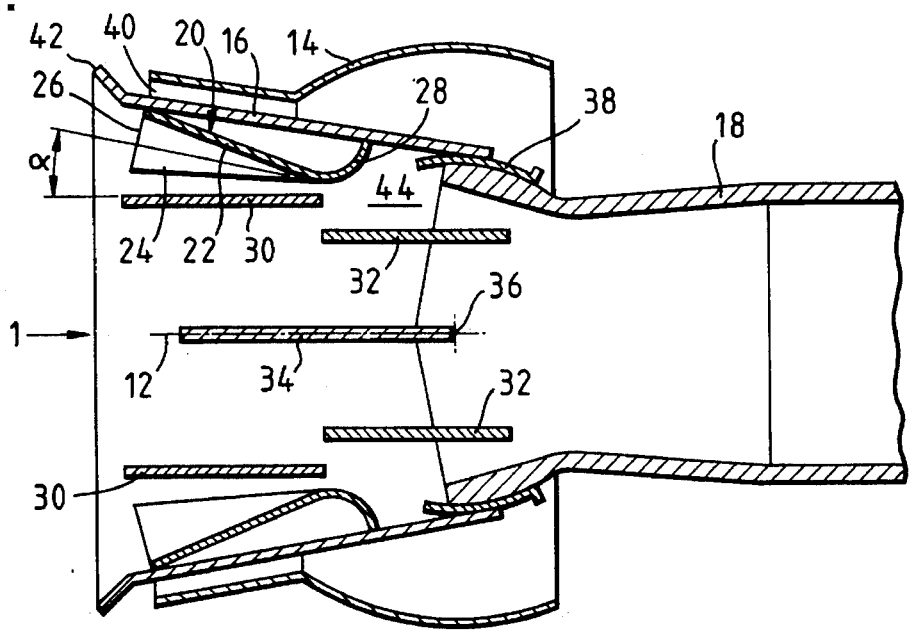
FIG. 2 is a view on line 2—2 in FIG. 1.

Referring to FIGS. 1 and 2 of the drawings. A burner 10 is generally rectangular in shape, in a plane normal to its axis 12.

The burner 10 consists of a cowl 14 surrounding a rectangular conduit 16 in peripherally spaced relationship. The conduit 16 diverges from its axis 12, in the general direction of travel of a mixture of pulverised coal and air, which in operation the conduit 16 receives from a feed pipe 18.

A fluted member 20 is affixed to each opposing upper and lower inner wall surface of the conduit 16, and is shaped so that the troughs 22 of the flutes also diverge in the same direction as the conduit 16, but at a larger angle to the axis 12 of the conduit 16 than the angle of divergence of the conduit 16 thereto.

The crests 24 of the flutes diverge from the conduit axis 12 at a very shallow angle, relative to the aforementioned angle of divergence.

The cross-sectional profile of the flutes is rectangular and their downstream end faces 26 are planer. Their upstream ends 28 are curved. the conduit 16. These devices are known per se.

For operation, the burner assembly 10 is pivotally connected to the coal/air feed pipe 18 via connection 36, and the cowl 14 supports a curved seal 38 which substantially fills the gap between the conduit 16 and the correspondingly curved, cooperating end of the feed pipe 18. This feature is also known per se.

In operation, a mixture of coal and air flows through the feed pipe 18 to the interior of the conduit 16 and, simultaneously, secondary air flows externally of the feed pipe 18 to the passage 40 defined by the cowl 14 and conduit 16.

That part of the coal/airflow which passes between the splitter plates 30 and their adjacent fluted members 20, is divided so as to, on the one hand be constricted by the flute crests 24 to flow in a direction substantially axially of the conduit 16 and on the other hand, allowed to expand into and along the troughs 22. The latter flow thus reduces its flow velocity prior to its ejection from the nozzle of the burner 10.

The secondary airflow from passage 40 is deflected outwardly of the axis 12 of the conduit 16 by the flared lip 42 thereon.

The overall effect of the divergent conduit 16, the fluted member 20 and the flared lip 42 consists of the provision of streams of low pressure, low velocity flow of a mixture of coal and air in the vicinity of the burner exit nozzle, such that on ignition of the mix, stable retention of the resulting flame on the plane faces 26 of the fluted member 20 is enabled.

The shape of the burner 10 and the advantages which accrue therefrom having been described hereinbefore, the skilled man will realise that the flowpath dimensions and relative angles of divergence thereof will depend on the flow characteristics of the respective fuel/air and secondary air upstream of the burner 10.

In general terms, experiment has shown that a nominal angle $\alpha$ of 12° defined by the splitter plate 30 and a line 44 drawn through the mean depth of the flutes of the fluted member 20, when combined with a throat dimension of, nominally, 11 mm, where the throat is defined by the splitter plate 30 and the closest point of the fluted member 20 to it, and a coal/air flow velocity of 25 m/sec centrally of the burner, a coal/airflow velocity reduction of 80% can be achieved through the troughs of the fluted member 20, which reduced flow on emerging from the burner, will not reverse its direction and will thus avoid carrying ash from the ambient atmosphere in the combustion chamber, into the burner interior.

Non reversal of the flow results directly from the fact that the burner proportions and flow characteristics described hereinbefore ensure that the flow does not break away from the troughs 22 of the features, thus avoiding flow recirculation.

Figure 3:
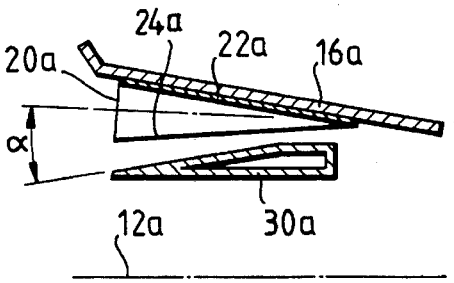
FIG. 3 is an axial cross sectional part view of an alternative arrangement of a burner in accordance with the present invention.

Referring to FIG. 3. In this alternative embodiment, the fluted member **20*a*, which corresponds in function to member 20, is effectively inverted in that the crests 24*a* converge towards the axis 12*a* of the conduit 16*a*. The troughs 22*a* however still diverge, but in this example, in parallel with the wall surfacing of conduit 16*a***

The splitter plate **30*a* is formed with its outer flow surface tapered with respect to the axis 12*a* and positioned with respect to the fluted member 20*a* so as to define a divergent flow passage between itself and the troughs 22*a* of the fluted member, which flow path is identical in effect with that of FIGS. 1 and 2, with the result that the same flow characteristics are achieved in the coal/air flow therethrough, as are achieved in the examples of FIGS. 1 and 2**.

Whilst the flutes of the fluted members 20 and 20*a* have been described as being rectangular cross sectional form, they could be of scalloped form without loss of performance.

I Claim:

1. A solid fuel burner comprising a hollow structure having an inlet connectable to particulate solid fuel and air delivery means and including a passage the inner wall of which diverges from said inlet to an outlet thereof, tapered fluted means being provided on the inner wall of the passage, the fluted means having troughs which are deepest at the outlet end of the passage, a splitter plate adjacent the troughs spans the interior of the hollow structure to define divergent passage portions which in operation cause a reduction in velocity of a particulate solid fuel/airflow therethrough to ensure flame retention on the planer downstream ends of the flutes and non breakaway of the particulate solid fuel/airflow from the surfaces of the troughs thereof, so as to avoid ash recirculation.

2. A solid fuel burner as claimed in claim 1 wherein the troughs of the fluted means diverge from the axis of the burner.

3. A solid fuel burner as claimed in claim 1 or claim 2 wherein the crests of the fluted means diverge from the axis of the burner.

4. A solid fuel burner as claimed in claim 1 or claim 2 wherein the crests of the fluted means and the splitter plate converge towards the axis of the burner.

5. A solid fuel burner as claimed in claim 1 wherein the flutes of the fluted means are rectangular in cross sectional shape.

6. A solid fuel burner as claimed in claim 1 wherein the flutes of the fluted means are serpentine in cross sectional shape.

* * * * *